US005797804A

United States Patent [19]

Chen

[11] Patent Number: 5,797,804

[45] Date of Patent: Aug. 25, 1998

[54] GOLF PUTTING ALIGNMENT TRAINER

[76] Inventor: Meng-Tsung Chen, No. 31, Lane 16, Bei-Chung Street, Tainan, Taiwan

[21] Appl. No.: 694,307

[22] Filed: Aug. 8, 1996

[51] Int. Cl.[6] ..... A63B 69/36

[52] U.S. Cl. ..... 473/260; 473/265

[58] Field of Search ..... 473/265, 260, 473/261, 262, 263, 264, 238

[56] References Cited

U.S. PATENT DOCUMENTS 4,423,875 1/1984 Miller ..... 473/265

*Primary Examiner*—George J. Marlo

*Attorney, Agent, or Firm*—Morton J. Rosenberg; David L Klein

[57] ABSTRACT

A golf putting alignment trainer includes a pair of spaced bodies each including: a hollow casing defining a compartment therein, an upper wall, and a rear wall, each of the hollow casings having a side opening which faces each other; a movable member mounted in the compartment of the hollow casing; a vertical adjustment device for mounting the movable member to the hollow casing and for affecting adjustment of a relative vertical position between the movable member and the hollow casing; a horizontal adjustment device for mounting the movable member to the hollow casing and for affecting adjustment of a relative horizontal position between the movable member and the hollow casing; and a scale attached to the movable member and adjustable in a horizontal position relative to the movable member.

4 Claims, 7 Drawing Sheets

GOLF PUTTING ALIGNMENT TRAINER

BACKGROUND OF THE INVENTION

1. Field of the Invention

The present invention relates to a golf putting alignment trainer which can be used for putters of different sizes and for different users.

2. Description of the Related Art

Golf is a popular sport which provides both leisure and sporting purposes. The goal of golfing is to hit the ball into the hole in the green. Thus, having a good putting knack is very important in this game. A good putting knack depends on controlling of the hitting angles between the putter and the ball as well as controlling of the magnitude of the hitting forces. However, different people have different hitting postures and different holding angles during putting. So, when the ball is putted, the putting angle is often deviated from due to personal customary movements. Thus, the players cannot always hit the ball at the right point. A further common problem for golf players during putting is the control of magnitude of the forces. As generally known, the ball stops short of the hole if the force is too weak, or the ball passes the hole if the force is too strong. Therefore, putting practice is always an important subject for golf players. The present invention is intended to provide a golf putting alignment trainer which meets this end.

SUMMARY OF THE INVENTION

It is an object of the present invention to provide a golf putting alignment trainer which can be used in any places for practicing the putting knack.

A golf putting alignment trainer in accordance with the present invention comprises a pair of spaced bodies each including: a hollow casing defining a compartment therein, an upper wall, and a rear wall, each of the hollow casings having a side opening which faces the other; a movable member mounted in the compartment of the hollow casing; a vertical adjustment means for mounting the movable member to the hollow casing and for affecting adjustment of a relative vertical position between the movable member and the hollow casing; a horizontal adjustment means for mounting the movable member to the hollow casing and for affecting adjustment of a relative vertical position between the movable member and the hollow casing; and a scale attached to the movable member and adjustable in a horizontal position relative to the movable member. Preferably, the scale is transparent.

Other objects, advantages, and novel features of the invention will become more apparent from the following detailed description when taken in conjunction with the accompanying drawings.

DESCRIPTION OF THE PREFERRED EMBODIMENT

Figure 1:
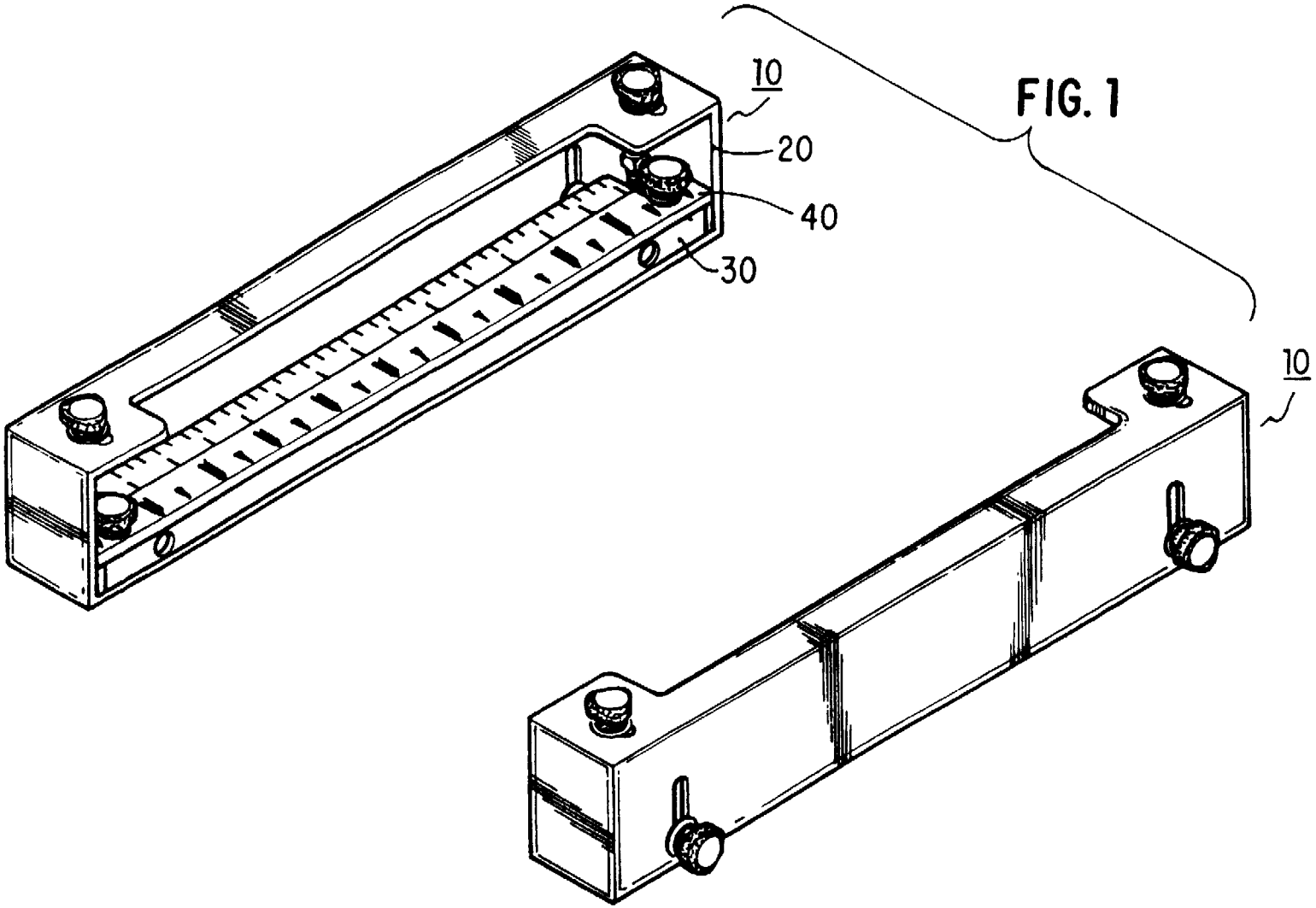
FIG. 1 is a perspective view of a golf putting alignment trainer in accordance with the present invention.
Figure 2:
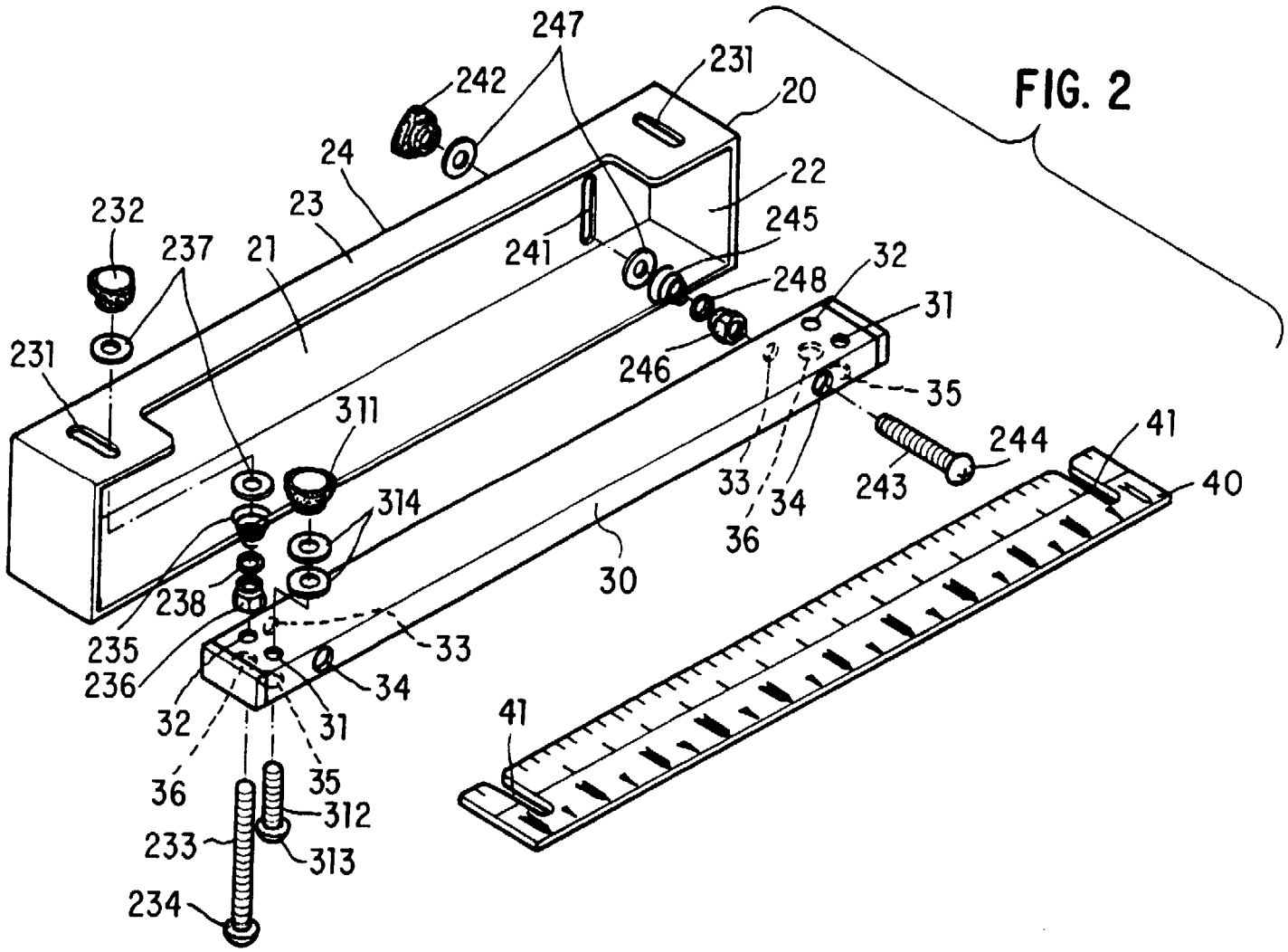
FIG. 2 is an exploded perspective view of a half structure of the golf putting alignment trainer in accordance with the present invention.
Figure 3:
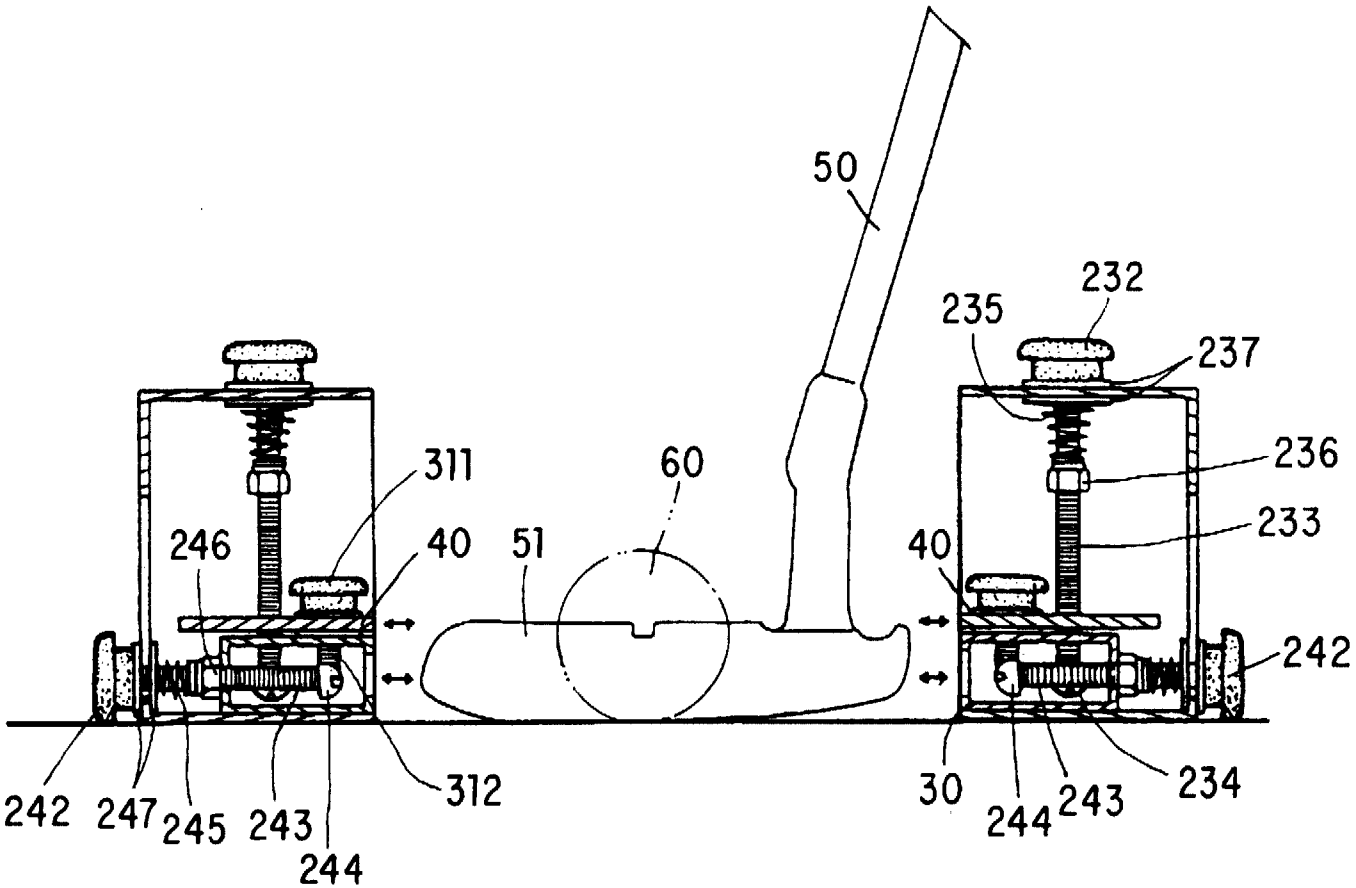
FIGS. 3 to 6 are cross-sectional views illustrating adjustments of the golf putting alignment trainer.
Figure 4:
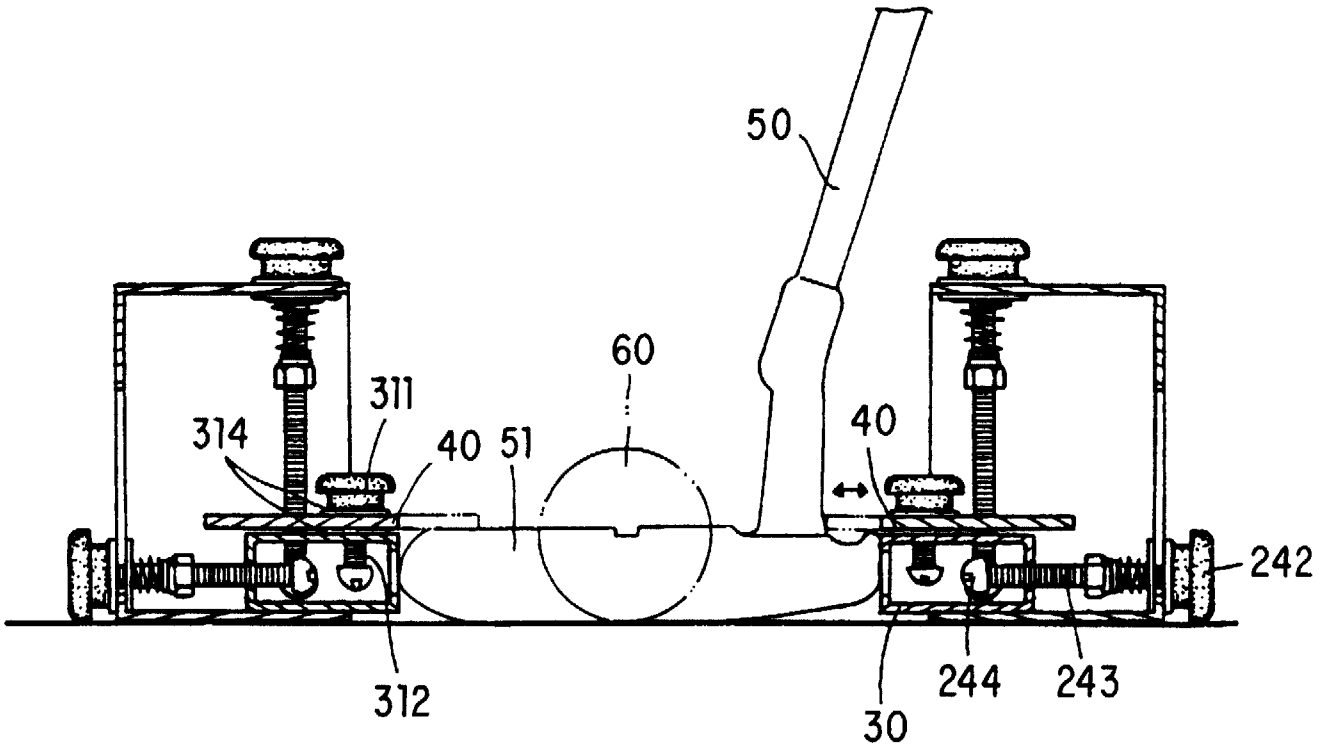

Referring to the drawings and initially to FIGS. 1 to 3, a golf putting alignment trainer in accordance with the present invention comprises a pair of spaced bodies 10 each including a hollow casing 20 defining a compartment 21 therein, an upper wall 23, and a rear wall 24. Each of the hollow casings 20 has a side opening 22 which faces the other. The upper wall 23 has a first slot 231 defined in each of two ends thereof, and the rear wall 24 has a second slot 241 defined in each of two ends thereof, as shown in FIG. 2.

A movable member 30 is mounted in the compartment 21 of each hollow casing 20 and includes a first vertical screw hole 31 and a second vertical screw hole 32 which are defined in each of two sides of an upper wall thereof. A third vertical screw hole 35 in alignment with the first vertical screw hole 31 and a fourth vertical screw hole 36 in alignment with the second vertical screw hole 32 are defined in each of two sides of a bottom wall of the movable plate 30. In addition, in each of two lateral walls of the movable member 30, two aligned horizontal screw holes 33 and 34 are respectively defined in each of two ends thereof, the purpose of which will be described hereinafter.

A scale 40, preferably transparent, is attached to the movable member 30 and is adjustable in a horizontal position relative to the movable member. The scale 40 includes a groove 41 defined in each of two ends thereof and extending in the horizontal direction.

Each body 10 further includes a vertical adjustment means for mounting the movable member 30 to the hollow casing 20 and for affecting adjustment of a relative vertical position between the movable member 30 and the hollow casing 20 and a horizontal adjustment means for mounting the movable member 30 to the hollow casing 20 and for affecting adjustment of a relative horizontal position between the movable member 30 and the hollow casing 20. In one preferred embodiment of the present invention, the vertical adjustment means and the horizontal adjustment means include screws 233, 243 and nuts 232, 242 as hereinafter described.

In assembly, referring to FIGS. 2 and 3, in respect to each body 10, the movable member 30 is placed into the compartment 21 of the hollow casing 20, and two first screws 233 are respectively extended through holes 36 and threaded through holes 32 in each end of the movable member, while a nut 236, a washer 238, a spring 235, a second washer 237 are mounted around each first screw 233 and inside the hollow casing 20 (see FIG. 3). Each first screw 233 is then extended through the associated slot 231 in the upper wall 23 of the hollow housing 20, and a further washer 237 and a fixed nut 232 are mounted around each first screw 233 above the hollow casing 20. The fixed nut 232 is fixedly mounted to the first screw 233 to rotate therewith.

Two second screws 243 are respectively extended through holes 34 and threaded through holes 33 in the lateral sides of the movable member 30, while a nut 246, a washer 248, a spring 245, a washer 247 are mounted around each second screw 243 and inside the hollow casing 20 (see FIG. 3). Each second screw 243 is then extended through the associated slot 241 in the rear wall 24 of the hollow housing 20, and a further washer 247 and a fixed nut 242 are mounted around each second screw 243 beyond the hollow casing 20. The fixed nut 242 is fixedly mounted to the second screw 243 to rotate therewith.

Two third screws 312 are respectively extended through holes 35 and 31 in each end of the movable member 30 and through the grooves 41 in the scale 40, while two washers 314 and a nut 311 are mounted around each third screw 312 and inside the hollow casing 20. Loosening of the nuts 311 allows adjustment of a horizontal position of the scale 40 relative to the movable plate 30.

Elasticity of the springs 235 and 245 avoids deviation of the screws 233 and 243 during respective vertical and horizontal movements thereof.

In use, referring to FIGS. 2 and 3, the bodies 10 are spaced apart on the ground with an appropriate distance therebetween. The golfer places a head 51 of a putter 50 between the bodies 10. Rotation of each fixed nut 242 causes free rotation of each screw 243, which, in turn, causes the associated movable member 30 to move horizontally (due to provision of the horizontal screw holes 33 and 34) toward the head 51 of the putter 50 until the movable members 30 respectively contact with front and rear ends of the head 51. Screw heads 244 of the screws 243 limit the maximum horizontal displacements of the movable members 30.

The scale 40, after heights thereof have been adjusted to fit the front and rear ends of the head 51 of the putter 50, are then adjusted in the horizontal direction to respectively abut tops of the front and rear ends of the head 51 of the putter 50, thereby reliably holding the head 51 of the putter 50.

Figure 5:
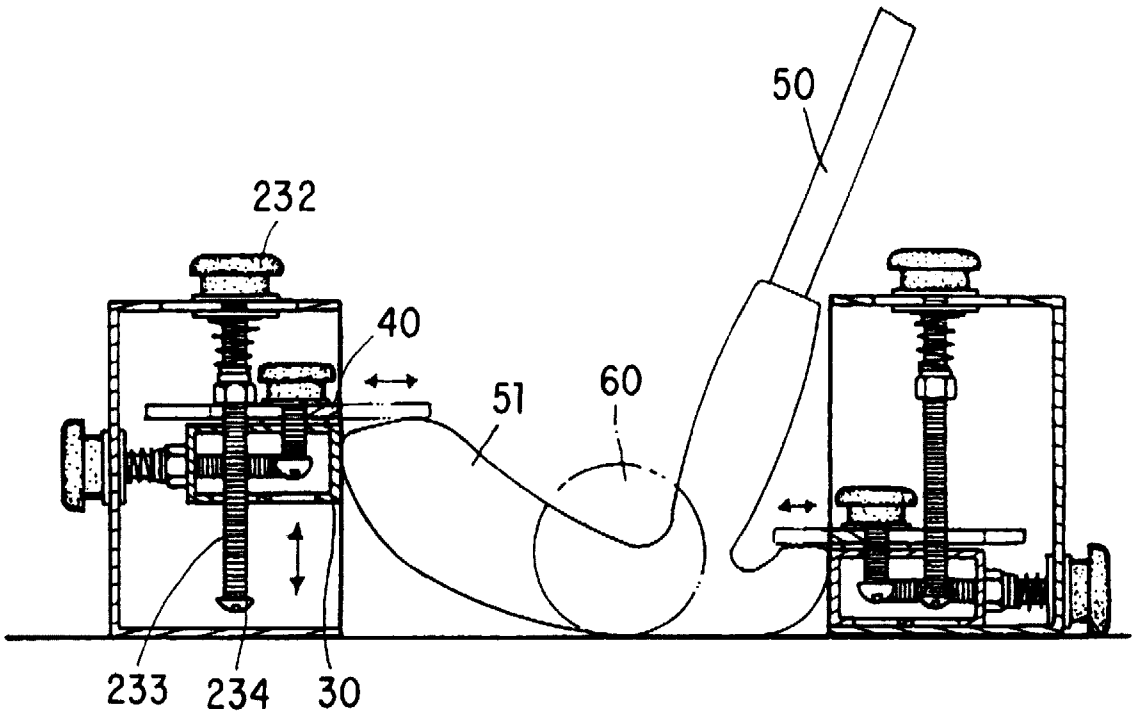
Figure 6:
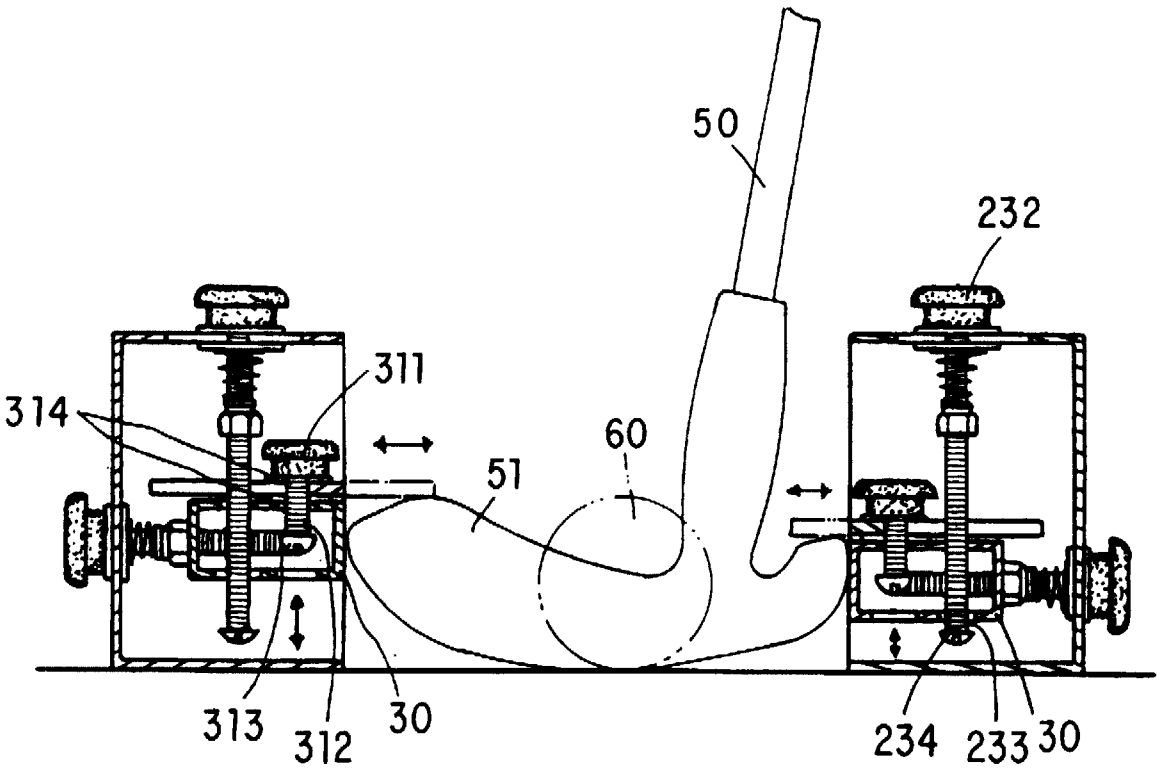

When heights of the front and rear ends of the head 51 of the putter 50 are changed, the golfer may simply rotate each fixed nut 232 to cause free rotation of each screw 233, which, in turn, causes the associated movable member 30 to move vertically (due to provision of the vertical screw holes 32 and 36) until the movable plates 30 are respectively located at a level the same as the front and rear ends of the hear 51 of the putter 50, as shown in FIGS. 5 and 6. Screw heads 234 of the screws 233 limit the maximum vertical displacements of the movable members 30. Again, the scales 40 are then adjusted in the horizontal direction to respectively abut tops of the front and rear ends of the head 51 of the putter 50, thereby reliably holding the head 51 of the putter 50.

Figure 7:
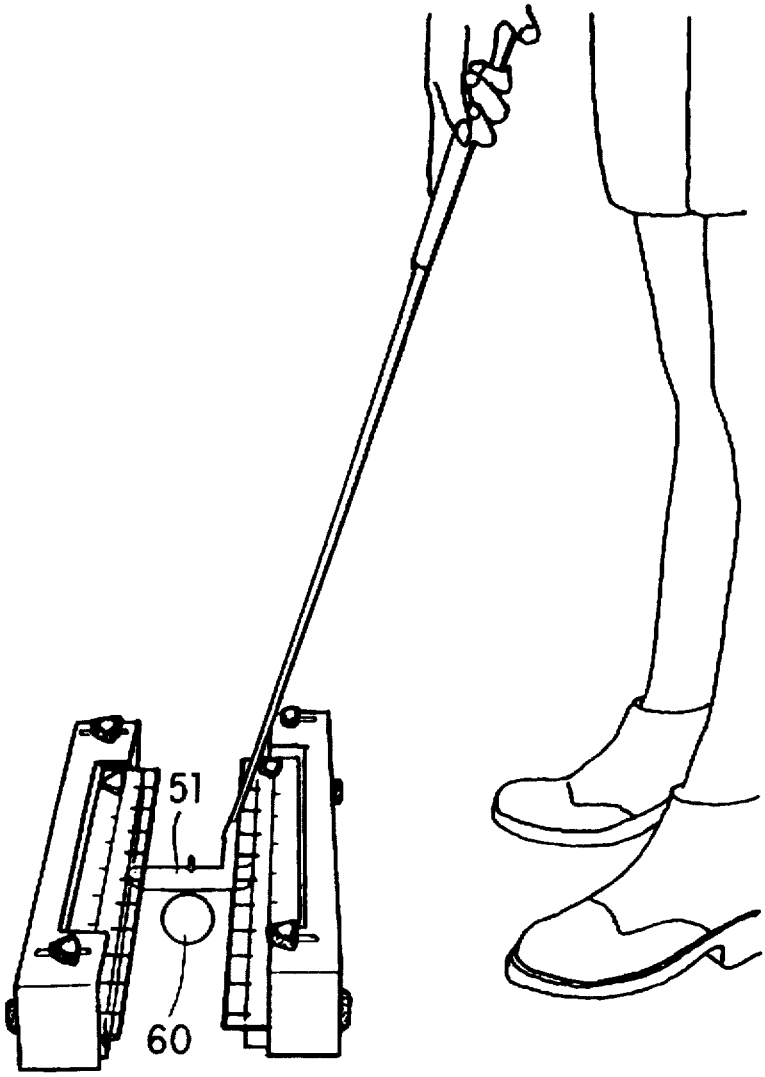
FIG. 7 is a perspective view illustrating use of the golf putting alignment trainer.

Referring to FIG. 7, the golfer may practice putting to achieve stability in his performance. In addition, the user may adjust the distance between the head 51 of the putter 50 and the ball 60 to correct the putting angle and the magnitude of forces for putting. The scale 40 is transparent and therefore does not obstruct the view of the golfer.

According to the above description, it is appreciated that the golf putting alignment trainer in accordance with the present invention includes the following advantages:

1. the structure is simple and can be easily installed and used;
2. the movable members 30 can be adjusted vertically and horizontally, while the scales 40 can be adjusted horizontally such that the golfer may select suitable putters to practice;
3. the putter is reliably held such that the golfer may obtain reliable stability during putting; and
4. the scales 40 allow the golfer to calculate the distance between the ball 60 and the putter 51 and to practice controlling of the magnitude of the putting forces for different distances.

Although the invention has been explained in relation to its preferred embodiment, it is to be understood that many other possible modifications and variations can be made without departing from the spirit and scope of the invention as hereinafter claimed.

What is claimed is:

1. A golf putting alignment trainer, comprising a pair of spaced bodies between which a user displaces a head portion of a putter to strike a ball, each said body comprising:

a hollow casing having a longitudinally extended compartment formed therein, an upper wall, and a rear wall, said hollow casing having an open side facing the head portion of the putter;

a movable member mounted in said compartment of said hollow casing and extending longitudinally therein;

vertical adjustment means coupled between said movable member and said upper wall of said hollow casing for affecting adjustment of a relative vertical position of said movable member within said compartment of said hollow casing;

horizontal adjustment means coupled between said movable member and said rear wall of said hollow casing and for affecting adjustment of a relative horizontal position of said movable member within said compartment of said hollow casing; and a scale coupled to said movable member and extending longitudinally thereon for indicating a distance between the head portion of the putter and a ball, said scale including means for adjusting a position thereof horizontally relative to said movable member.

2. The golf putting alignment trainer as claimed in claim 1, wherein the scale is transparent.

3. The golf putting alignment trainer as claimed in claim 1, wherein said vertical adjustment means includes:

a pair of threaded members passing through respective threaded openings formed in opposing ends of said movable member and slotted openings formed through said upper wall of said hollow casing;

a pair of first nuts respectively affixed to a distal end of said pair of threaded members adjacent said upper wall of said hollow casing;

a pair of second nuts respectively threadedly coupled to said pair of threaded members in spaced relationship with said pair of first nuts and disposed on an opposing side of said upper wall of said hollow casing; and, a pair of springs respectively disposed on said pair of threaded members between said upper wall of said hollow casing and said pair of second nuts for applying a bias force thereto.

4. The golf putting alignment trainer as claimed in claim 1, wherein said horizontal adjustment means includes:

a pair of threaded members passing through respective threaded openings formed in opposing ends of said movable member and slotted openings formed through said rear wall of said hollow casing;

a pair of first nuts respectively affixed to a distal end of said pair of threaded members adjacent said rear wall of said hollow casing;

a pair of second nuts respectively threadedly coupled to said pair of threaded members in spaced relationship with said pair of first nuts and disposed on an opposing side of said rear wall of said hollow casing; and, a pair of springs respectively disposed on said pair of threaded members between said rear wall of said hollow casing and said pair of second nuts for applying a bias force thereto.

* * * * *